US007482986B2

(12) United States Patent
Wu et al.

(10) Patent No.: US 7,482,986 B2
(45) Date of Patent: Jan. 27, 2009

(54) MULTI-BAND ANTENNA

(75) Inventors: Hsin-tsung Wu, Tu-Cheng (TW); Kai Shih, Tu-Cheng (TW); Yu-yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 62 days.

(21) Appl. No.: 11/808,142

(22) Filed: Jun. 7, 2007

(65) Prior Publication Data

US 2008/0303731 A1 Dec. 11, 2008

(51) Int. Cl.
*H01Q 1/24* (2006.01)

(52) U.S. Cl. ..... 343/702

(58) Field of Classification Search ..... 343/702, 343/700 MS, 767, 846–848
See application file for complete search history.

(56) References Cited

U.S. PATENT DOCUMENTS 6,111,544 A * 8/2000 Dakeya et al. ..... 343/700 MS
6,897,810 B2 * 5/2005 Dai et al. ..... 343/700 MS
6,982,673 B2 * 1/2006 Yuanzhu ..... 343/700 MS
7,034,754 B2 * 4/2006 Hung et al. ..... 343/700 MS
7,218,280 B2 * 5/2007 Annamaa et al. ..... 343/700 MS
7,237,318 B2 * 7/2007 Annamaa et al. ..... 29/600
7,391,375 B1 * 6/2008 Lin et al. ..... 343/700 MS
2007/0188384 A1 * 8/2007 Liu ..... 343/700 MS

* cited by examiner

*Primary Examiner*—Huedung Mancuso
(74) *Attorney, Agent, or Firm*—Rosenberg, Klein & Lee

(57) ABSTRACT

A multi-band antenna has a radiating conductor, a feeding conductor and a short conductor. The feeding conductor and the short conductor connect to one side of the radiating conductor, which are arranged close to each other. The radiating conductor has a slot containing an opening portion, a first extension portion and a second extension portion communicating with each other. The opening portion opening at the other side of the radiating conductor and the first and second extension portions extend to different directions. The second extension portion defines a short portion on the radiating conductor. The multi-band antenna is divided by the slot to form an inverted-F portion being similar to an inverted-F antenna to resonate at a first frequency band, and a loop portion being similar to a loop antenna to resonate at a second frequency band.

8 Claims, 4 Drawing Sheets

MULTI-BAND ANTENNA

BACKGROUND OF THE INVENTION

1. Field of the Invention

The invention relates to a multi-band antenna, and particularly to a multi-band antenna capable of operating at various wireless communication frequency bands and eliminating parasitic effect.

2. The Related Art

A portable communication device has an antenna that supports wireless communication in multiple operating frequency bands, such as global system for mobile communications (GSM). Wireless communication bands include global system for mobile communications (GSM) band about 850 mega-hertz (MHz), extended global system for mobile communications (EGSM) band about 900 MHz, digital cellular system (DCS) band about 1800 MHz and personal conferencing specification (PCS) band about 1900 MHz.

Many different types of antennas for the portable communication device are used, including helix, monopole, inverted-F, dipole, patch, loop and retractable antennas. Helix antenna and retractable antenna are typically installed outside the portable communication device. Inverted-F antenna, monopole antenna, patch antenna, loop antenna and dipole antenna are typically embedded inside the portable communication device case or housing.

Generally, embedded antennas are preferred over external antennas for the portable communication device owing to mechanical and ergonomic reasons. Embedded antennas are protected by the portable communication device case or housing and therefore tend to be more durable than external antennas. The volume of dipole antenna is large than the volume of monopole antenna because dipole antenna has a positive radiating body and a negative radiating body but monopole has one radiating body.

The volume of patch antenna is smaller than the volume of monopole antenna because monopole antenna is bent to form patch antenna. However, capacitance effect of patch antenna is increased because patch antenna is bent. For the purpose of eliminating capacitance effect of patch antenna, inverted-F antenna has a short portion connected to ground. Loop antenna is similar to dipole antenna having a positive radiating body and a negative radiating body. However two ends of loop antenna connect signal transmitter and ground to form an electric path. Therefore, gain effect of loop antenna is better than gain effect of dipole antenna. The volume of inverted-F antenna is smaller than other type antennas.

In recently, the portable communication device such as a mobile phone for downsizing issue contains problems both at closed state and opened state as well. The mobile phone is operated at wireless communication in opened state, else in closed state. When the mobile phone is in opened state, the movable housing of the mobile phone relatively moves to the main housing of the mobile phone.

According to the movement of the main housing and the movable housing, a main printed circuit board received in the main housing and a sub printed circuit board received in the movable housing relatively move to each other to form parasitic effect to influence gain of antenna of the mobile phone.

Therefore, the antenna capable of operating at various wireless communication bands, eliminating parasitic effect and being configured in the portable communication device is a development point.

SUMMARY OF THE INVENTION

An object of the present invention is to provide a multi-band antenna having a radiating conductor, a feeding conductor and a short conductor. The radiating conductor defines a first side, a second side opposite to the first side, a third side and a fourth side opposite to the third side. The feeding conductor and the short conductor connect to the fourth side of the radiating conductor. The short conductor is close to the feeding conductor.

A slot is opened at the radiating conductor having an opening portion, a first extension portion and a second extension. The opening portion of the slot opens at the first side of the radiating conductor and extends to the second side of the radiating conductor. The first extension portion communicates with the opening portion and extends to the third side of the radiating conductor. The second extension portion communicates with the opening portion and the first extension portion and extends to the fourth side of the radiating conductor. The radiating conductor has a short portion surrounded by the second extension portion of the slot.

The multi-band antenna is divided to form an inverted-F portion and a loop portion by the slot. Electric characteristic of the inverted-F portion of the multi-band antenna is similar to an inverted-F antenna to obtain a first bandwidth covering 850 MHz and 900 MHz. Electric characteristic of the loop portion of the multi-band antenna is similar to a loop antenna to obtain a second bandwidth covering 1800 MHz and 1900 MHz.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
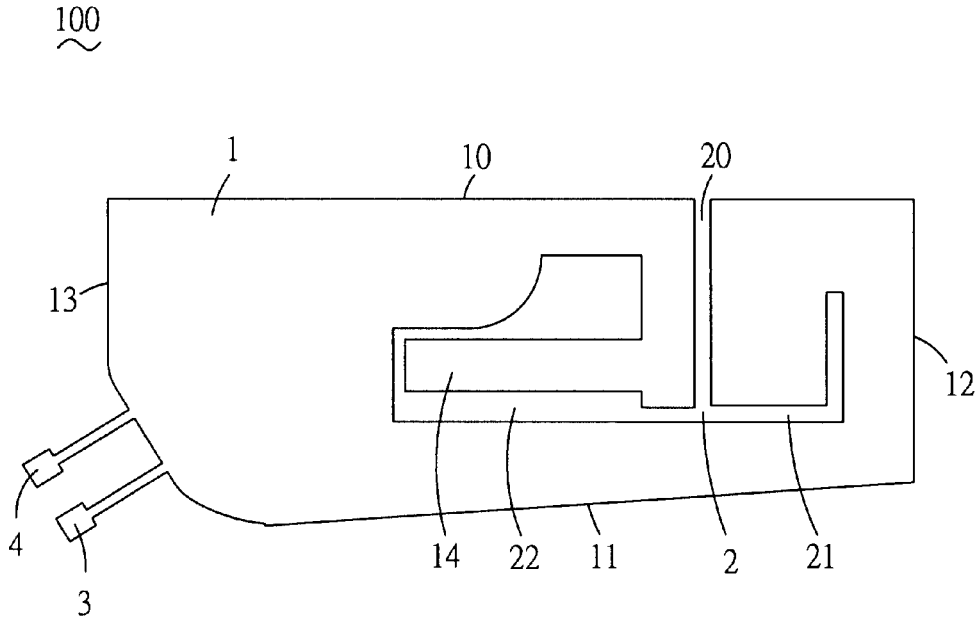
FIG. 1 shows a preferred embodiment of a multi-band antenna according to the present invention.

Please refer to FIG. 1. A preferred embodiment of a multi-band antenna 100 according to the present invention is shown. The multi-band antenna 100 has a radiating conductor 1, a feeding conductor 3 and a short conductor 4. The radiating conductor 1 defines a first side 10, a second side 11 opposite to the first side 10, a third side 12 and a fourth side 13 opposite to the third side 12.

The feeding conductor 3 and the short conductor 4 connect to the fourth side 13 of the radiating conductor 1. The short conductor 4 is close to the feeding conductor 3. A slot 2 is opened at the radiating conductor 1 having an opening portion 20, a first extension portion 21 and a second extension portion 22. The opening portion 20, the first extension portion 21 and the second extension portion 22 of the slot 2 communicate with each other.

The opening portion 20 defines a first end opening at the first side 10 of the radiating conductor 1 and a second end extending towards the second side 11 of the radiating conductor 1. The first extension portion 21 communicates with the second end of the opening portion 20 and extends towards the third side 12 of the radiating conductor 1. The second extension portion 22 communicates with the second end of the opening portion 20 and extends towards the fourth side 13 of the radiating conductor 1.

In this case, the first extension portion 21 extends to the third side 12 of the radiating conductor 1 and turns towards the first side 10 of the radiating conductor 1 to form as L-shape. The second extension portion 22 extends to the fourth side 13 of the radiating conductor 1 to divide the radiating conductor 1 to form a short portion 14. In this case, the second extension portion 22 forms as U-shape and surrounds the short portion 14. Furthermore, the extension portion 22 is not limited to form as U-shape. The extension portion 22 can form as cycle shape or volute shape.

Figure 2:
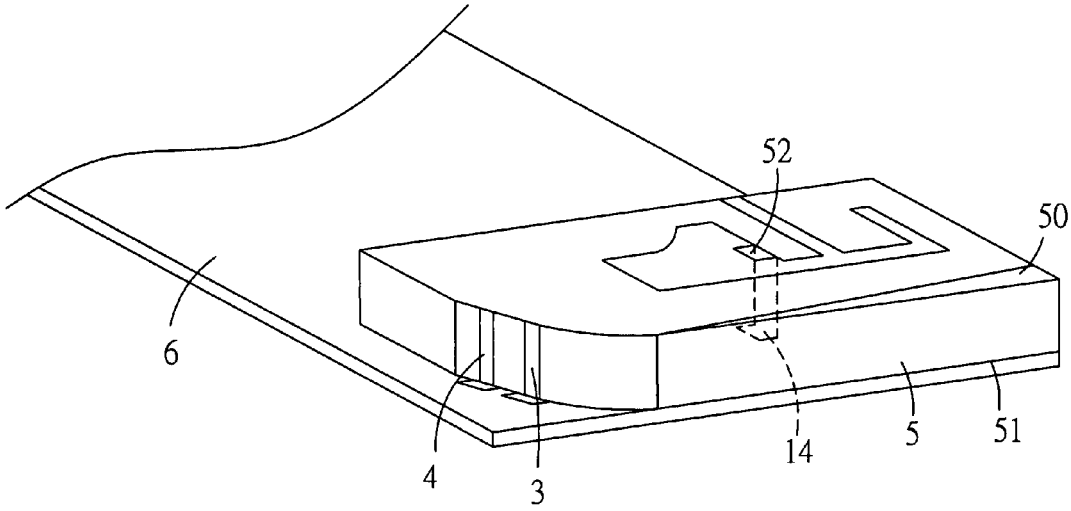
FIG. 2 shows the multi-band antenna being supported by a dielectric element and connected to a printed circuit board which is received in a mobile phone according to the present invention.

Please refer to FIG. 2. The multi-band antenna 100 is supported by a dielectric element 5 and connects to a printed circuit board 6 of a mobile phone (not shown in figures). In this case, the dielectric element 5 has a top surface 50, a bottom surface 51 and a through hole 52 opened through the top surface 50 and the bottom surface 51. The radiating conductor 1 is attached on the top surface 50 of the dielectric element 5. The bottom surface 51 of the dielectric element 5 is attached on the printed circuit board 6.

The feeding conductor 3 and the short conductor 4 bend towards the printed circuit board 6 and electronically connect to a signal processor and a ground portion (not shown in figures) on the printed circuit board 6 respectively. The short portion 14 of the multi-band antenna 100 bends towards the printed circuit board 6 through the through hole 52 of the dielectric element 5 and electronically connects to the ground portion on the printed circuit board 6.

The multi-band antenna 100 is divided by the slot 2 to form a first electric path, a second electric path and a third electric path. When the signal processor sends a signal to the multi-band antenna 100, the signal is fed from the feeding conductor 3 and passed to the short conductor 4 to form the first electric path. The signal is fed to the feeding conductor 3, passed along the first extension portion 21 of the slot 2 to form the second electric path. The signal is fed to the feeding conductor 3, passed along the second extension portion 22 of the slot 2 and then passed to the short portion 14 to form the third electric path. The first electric path and the second electric path form an inverted-F portion, and the third electric path forms a loop portion.

In this case, electric characteristic of the inverted-F portion is similar to an inverted-F antenna to obtain an electrical resonance corresponding to a quarter wavelength corresponding to a first frequency bandwidth covering 850 MHz and 900 MHz. Electric characteristic of the loop portion is similar to the loop antenna to obtain an electrical resonance corresponding to a half wavelength corresponding to a second frequency bandwidth covering 1800 MHz and 1900 MHz.

Figure 3:
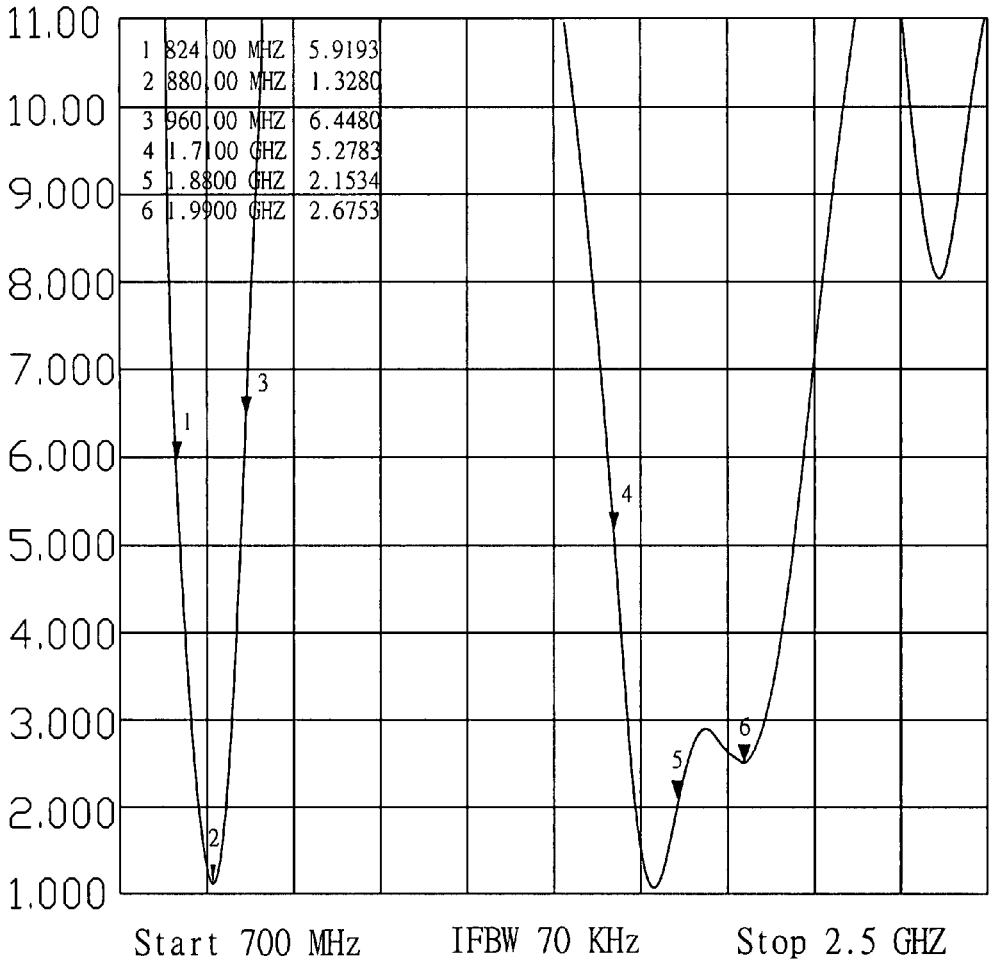
FIG. 3 shows a Voltage Standing Wave Ratio (VSWR) test chart of the multi-band antenna when the multi-band antenna is configured in the mobile phone, and the mobile phone is in close state.

Please refer to FIG. 3, which shows a Voltage Standing Wave Ratio (VSWR) test chart of the multi-band antenna 100 when the multi-band antenna 100 is configured in the mobile phone (not shown in figures), and the mobile phone is in close state. When the multi-band antenna 100 operates at 824 MHz, the VSWR value is 5.9193. When the multi-band antenna 100 operates at 880 MHz, the VSWR value is 1.328. The VSWR value is 6.448, when the multi-band antenna 100 operates at 960 MHz. The VSWR value is 5.2783, when the multi-band antenna 100 operates at 1710 MHz. The VSWR value is 2.1534, when the multi-band antenna 100 operates at 1880 MHz. The VSWR value is 2.6753, when the multi-band antenna 100 operates at 1990 MHz.

Figure 4:
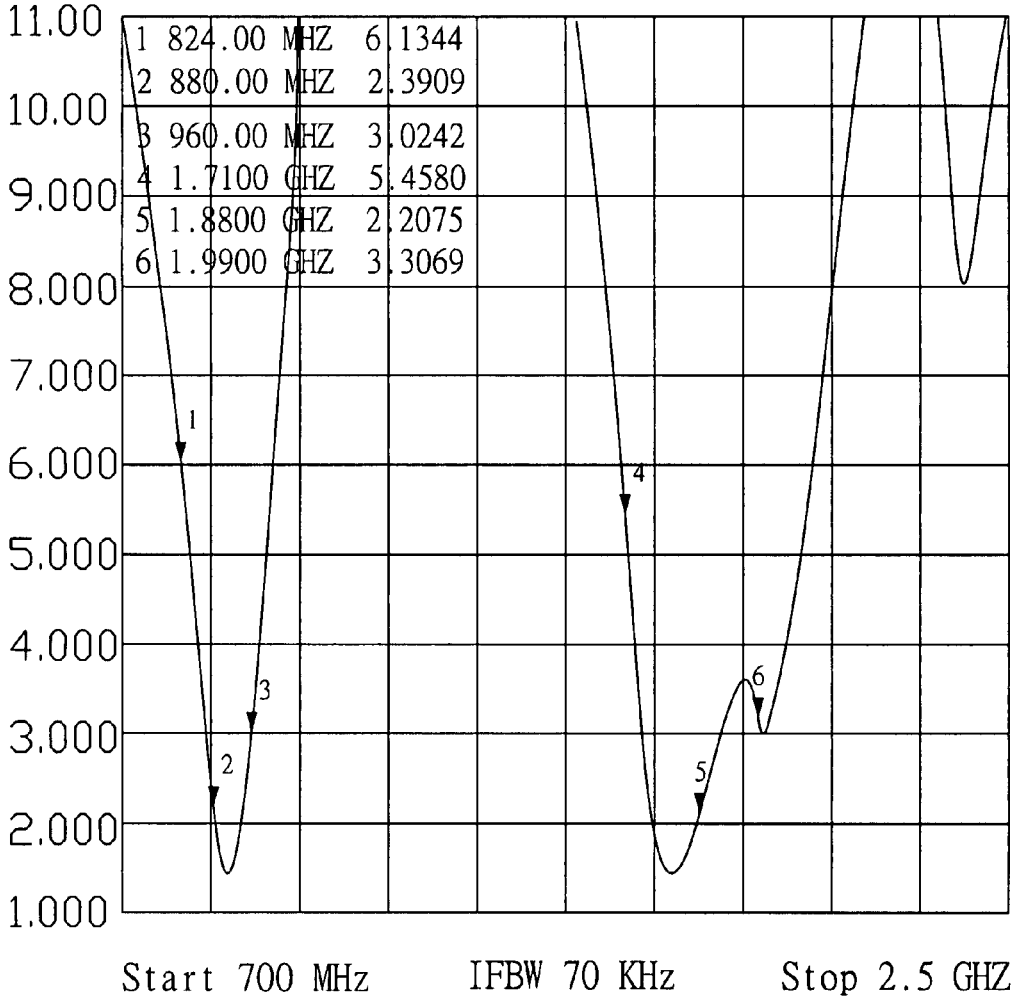
FIG. 4 shows a Voltage Standing Wave Ratio (VSWR) test chart of the multi-band antenna when the multi-band antenna is configured in the mobile phone, and the mobile phone is in open state.

Please refer to FIG. 4, which shows a Voltage Standing Wave Ratio (VSWR) test chart of the multi-band antenna 100 when the multi-band antenna 100 is configured in the mobile phone, and the mobile phone is in open state. When the multi-band antenna 100 operates at 824 MHz, the VSWR value is 6.1344. When the multi-band antenna 100 operates at 880 MHz, the VSWR value is 2.3909. The VSWR value is 3.0242, when the multi-band antenna 100 operates at 960 MHz. The VSWR value is 5.459, when the multi-band antenna 100 operates at 1710 MHz. The VSWR value is 2.2075, when the multi-band antenna 100 operates at 1880 MHz. The VSWR value is 3.3069, when the multi-band antenna 100 operates at 1990 MHz.

VSWR value of the multi-band antenna 100 configured in the mobile phone in open state is similar to VSWR value of the multi-band antenna 100 configured in the mobile phone in close state. Therefore, the multi-band antenna 100 can eliminate parasitic effect when the state of the mobile phone is changed.

Therefore, the multi-band antenna 100 contains the inverted-F portion resonating at first frequency bandwidth covering 850 MHz and 900 MHz and the loop portion resonating at second frequency bandwidth covering 1800 MHz and 1900 MHz. Because electric characteristic of the inverted-F portion and the loop portion of the multi-band antenna 100 is similar to inverted-F antenna and loop antenna, volume of the multi-band antenna 100 is small and gain of the multi-band antenna 100 is high enough to eliminate parasitic effect.

Furthermore, the present invention is not limited to the embodiments described above; various additions, alterations and the like may be made within the scope of the present invention by a person skilled in the art. For example, respective embodiments may be appropriately combined.

What is claimed is:

1. A multi-band antenna electronically connecting with a signal processor and a ground portion arranged on a printed circuit board, comprising:

a radiating conductor defining a first side, a second side opposite to said first side, a third side, a fourth side opposite to said third side;

a feeding conductor connecting said fourth side of said radiating conductor and said signal processor;

a short conductor arranged close to said feeding conductor and connecting said fourth side of said radiating conductor and said ground portion;

a slot having an opening portion opening at said first side of said radiating conductor, a first extension portion communicating with said opening portion and extending towards said third side of said radiating conductor, and a second extension portion communicating with said opening portion and extending towards said fourth side of said radiating conductor, wherein said second extension portion of said slot defines a short portion connecting said ground portion.

2. The multi-band antenna as claimed in claim 1, wherein said first extension portion has at least one turn.

3. The multi-band antenna as claimed in claim 1, wherein said second extension portion of said slot surrounds said short portion of said radiating conductor.

4. The multi-band antenna as claimed in claim 1, further comprising a dielectric element having a top surface, a bottom surface opposite to said top surface and a through hole opened through said top surface and said bottom surface, said dielectric element arranged on said printed circuit board, said multi-band antenna arranged on said dielectric element, said short portion of said radiating conductor of said multi-band antenna passing through said through hole of said dielectric element.

5. A multi-band antenna electronically connecting with a signal processor and a ground portion arranged on a printed circuit board, comprising:

a radiating conductor;

a feeding conductor connecting to said radiating conductor;

a short conductor connecting to said radiating conductor and arranged close to said feeding conductor; and a slot having an opening portion, a first extension portion and a second extension portion communicating with each other, said opening portion opened at one side of said radiating conductor, said second extension portion defining a short portion on said radiating conductor, wherein said multi-band antenna is divided by said slot to form an inverted-F portion being similar to an inverted-F antenna, and a loop portion being similar to a loop antenna.

6. The multi-band antenna as claimed in claim 5, wherein said first extension portion and said second extension portion extend in different directions, said second extension portion surrounding said ground portion of said radiating conductor.

7. The multi-band antenna as claimed in claim 5, wherein said inverted-F portion resonates at first frequency band, said loop portion resonates at second frequency band, said second frequency band is higher than said first frequency band.

8. The multi-band antenna as claimed in claim 5, further comprising a dielectric element having a top surface, a bottom surface opposite to said top surface and a through hole opened through said top surface and said bottom surface, said dielectric element arranged on said printed circuit board, said multi-band antenna arranged on said dielectric element, said short portion of said radiating conductor of said multi-band antenna passing through said through hole of said dielectric element.

* * * * *